US006916773B2

(12) United States Patent
Griese et al.

(10) Patent No.: US 6,916,773 B2
(45) Date of Patent: Jul. 12, 2005

(54) NON-SURFACTANT SOLUBILIZING AGENT

(75) Inventors: Greg Griese, Hudson, WI (US); Mark Levitt, St. Paul, MN (US)

(73) Assignee: Ecolab, Inc., St. Paul, MN (US)

( * ) Notice: Subject to any disclaimer, the term of this patent is extended or adjusted under 35 U.S.C. 154(b) by 0 days.

(21) Appl. No.: 10/210,390

(22) Filed: Jul. 31, 2002

(65) Prior Publication Data

US 2004/0026665 A1 Feb. 12, 2004

(51) Int. Cl.[7] ..... C11D 1/04; C23G 5/032; B01F 1/00

(52) U.S. Cl. ..... 510/245; 510/306; 510/365; 510/407; 510/488; 510/506; 252/364

(58) Field of Search ..... 252/364; 510/245, 510/306, 365, 488, 506, 407

(56) References Cited

U.S. PATENT DOCUMENTS

| | | | | |
|---|---|---|---|---|
| 2,534,074 | A | 12/1950 | Shmidl | |
| 3,048,548 | A | 8/1962 | Martin et al. | |
| 3,334,147 | A | 8/1967 | Brunelle et al. | |
| 3,442,242 | A | 5/1969 | Laskey et al. | |
| 3,546,124 | A | * 12/1970 | Fleischer | |
| 3,929,721 | A | 12/1975 | Leverett | |
| 4,305,837 | A | * 12/1981 | Kaminsky et al. | |
| 4,578,209 | A | * 3/1986 | Hisamoto et al. | |
| 4,618,914 | A | 10/1986 | Sato et al. | 361/315 |
| 4,627,931 | A | 12/1986 | Malik | |
| 4,749,509 | A | 6/1988 | Kacher | |
| 4,784,789 | A | 11/1988 | Jeschke et al. | |
| 4,830,773 | A | 5/1989 | Olson | |
| 4,851,324 | A | 7/1989 | Hsieh | 430/331 |
| 5,080,822 | A | 1/1992 | VanEenam | |
| 5,080,831 | A | 1/1992 | VanEenam | |
| 5,158,710 | A | 10/1992 | VanEenam | |
| 5,275,753 | A | * 1/1994 | de Buzzaccarini et al. | |
| 5,336,426 | A | * 8/1994 | Rader et al. | |
| 5,399,672 | A | 3/1995 | Jalalian et al. | 530/403 |
| 5,419,848 | A | 5/1995 | VanEenam | |
| 5,454,985 | A | * 10/1995 | Harbin | |
| 5,585,341 | A | 12/1996 | VanEenam | 510/365 |
| 5,750,487 | A | * 5/1998 | Oldenhove et al. | 510/365 |
| 5,849,682 | A | 12/1998 | Van Eenam | 510/254 |
| 5,962,388 | A | 10/1999 | Sherry et al. | 510/238 |
| 6,010,995 | A | 1/2000 | Van Eenam | 510/365 |
| 2002/0058600 | A1 | 5/2002 | Van Eenam | |

FOREIGN PATENT DOCUMENTS

| | | |
|---|---|---|
| DE | 199 22 538 | 11/2000 |
| EP | 0 164 467 | 8/1984 |
| WO | WO 91/09104 | 12/1990 |
| WO | WO 01/10961 | 2/2001 |
| WO | WO 02/06435 | 1/2002 |

OTHER PUBLICATIONS

"Material Safety Data Sheet", MSDS No. 4044, The Butcher Company, pp. 1–7, Oct. 19, 2000.
"Material Safety Data Sheet", MSDS No. 4234, The Butcher Company, pp. 1–7, Dec. 18, 2000.

* cited by examiner

*Primary Examiner*—Daniel S. Metzmaier
(74) *Attorney, Agent, or Firm*—Crompton, Seager, Tufte LLC

(57) ABSTRACT

Compositions of the invention include: (a) a solvent having a hydrophilic-lipophilic balance (HLB) value of 5 to 7; and (b) a solubilizing agent having the formula:

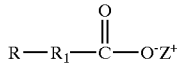

where R is aryl, cycloaryl, heteroaryl or hetercyclyl; $R_1$ is a bond, $(C_1–C_7)$alkyl, substituted $(C_1–C_7)$alkyl, $(C_1–C_7)$ alkoxy, substituted $(C_1–C_7)$alkoxy, $(C_2–C_7)$alkenyl or substituted $(C_2–C_7)$alkenyl; and $Z_+$ is hydrogen, Na, K, $NR'_4$ where R' is defined herein. Further compositions include: (a) a solvent having a (HLB) value of 5 to 7; and (b) a solubilizing agent having the formula:

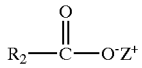

where $R_2$ is a bond, $(C_1–C_7)$alkyl, substituted $(C_1–C_7)$alkyl, $(C_1–C_7)$alkoxy, substituted $(C_1–C_7)$alkoxy, $(C_2–C_7)$alkenyl or substituted $(C_2–C_7)$alkenyl; and $Z^+$ is hydrogen, Na, K, $NR'_4$ where R' is defined herein. The compositions are useful in providing stable single phase aqueous solutions when combined with water.

52 Claims, No Drawings

NON-SURFACTANT SOLUBILIZING AGENT

BACKGROUND OF THE INVENTION

The invention relates to cleaner/degreaser compositions and, more particularly, to stable cleaner/degreaser compositions that include solvents with an HLB value between 5 and 7 made soluble in water with a non-surfactant solubilizing agent.

While not wishing to be held to any theory as to the nature of the cleaning and degreasing action of presently available compositions, it is believed that highly or infinitely water soluble organic solvents presently used in both retail as well as industrial and institutional cleaner/degreaser compositions are too hydrophilic in nature to function effectively in removing hydrophobic "oleophilic" soilants, especially in the presence of diluting water. As the level of the latter is increased to bring conventional compositions to ready to use strength, the solvating action of the organic solvent is drastically reduced with a consequent and marked reduction in the cleaning/degreasing action required for effective cleaning and oily soilant removal.

There remains a need, therefore, for cleaning, degreaser compositions with improved cleaning and degreasing capabilities where the solubilizing agent is a non surfactant solubilizing agent and without the other deficiencies of presently available cleaner/degreaser compositions.

DETAILED DESCRIPTION

Definitions

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

Weight percent, percent by weight, % by weight, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

The term "alkyl" refers to a straight or branched chain monovalent hydrocarbon radical having a specified number of carbon atoms. Alkyl groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example. Examples of "alkyl" include, but are not limited to, methyl, ethyl, n-propyl, isopropyl, n-butyl, s-butyl, t-butyl, n-pentyl, n-hexyl, 3-methylpentyl, and the like.

The term "alkoxy" refers to refers to a straight or branched chain monovalent hydrocarbon radical having a specified number of carbon atoms and a carbon-oxygen-carbon bond, may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example. Examples include, methoxy, ethoxy, propoxy, t-butoxy, and the like.

The term "alkenyl" or "alkenylene" refers to a straight or branched chain divalent hydrocarbon radical having a specified number of carbon atoms and one or more carbon—carbon double bonds. Alkenylene groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example. Examples of "alkenyl" or "alkenylene" include, but are not limited to, ethene-1,2-diyl, propene-1,3-diyl, and the like.

The term "cycloalkyl" refers to an alicyclic hydrocarbon group having a specified number of carbon atoms. Cycloalkyl groups include those with one to twelve carbon atoms. Cycloalkyl groups may be saturated or unsaturated, unsubstituted or substituted with those substituents that do not interfere with the specified function of the composition. Cycloalkyl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such a cycloalkyl ring may be optionally fused to one or more of another heteroaryl ring(s), aryl ring(s), or cycloalkyl rings. Examples of "cycloalkyl" include, but are not limited to, cyclopropyl, cyclobutyl, cyclopentyl, cyclohexyl, cycloheptyl, or cyclooctyl, and the like.

The term "heterocyclic" or "heterocyclyl" refers to a monovalent three to twelve-membered non-aromatic ring containing one or more heteroatomic substitutions independently selected from S, O, or N and having zero to five degrees of unsaturation. Heterocyclyl groups may be unsubstituted or substituted with those substituents that do not interfere with the specified function of the composition. Heterocyclyl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such a heterocyclic ring may be optionally fused to one or more of another heterocyclic ring(s), heteroaryl ring(s), aryl ring(s), or cycloalkyl rings. Examples of "heterocyclic" include, but are not limited to, tetrahydrofuryl, pyranyl, 1,4-dioxanyl, 1,3-dioxanyl, piperidinyl, pyrrolidinyl, morpholinyl, tetrahydrothiopyranyl, tetrahydrothiophenyl, and the like.

The term "aryl" refers to monovalent unsaturated aromatic carbocyclic radicals having a single ring, such as phenyl, or multiple condensed rings, such as naphthyl or anthryl. Aryl groups may be unsubstituted or substituted with those substituents that do not interfere with the specified function of the composition. Aryl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such an aryl ring may be optionally fused to one or more of another heterocyclic ring(s), heteroaryl ring(s), aryl ring(s), or cycloalkyl rings. Examples of "aryl" include, but are not limited to, phenyl, 2-naphthyl, 1-naphthyl, biphenyl, 2-hydroxyphenyl, 2-aminophenyl, 2-methoxyphenyl and the like.

The term "heteroaryl" refers to a monovalent five to seven membered aromatic ring radical containing one or more heteroatoms independently selected from S, O, or N. Heteroaryl groups may be unsubstituted or substituted with those substituents that do not interfere with the specified function of the composition. Heteroaryl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such a "heteroaryl" ring may be optionally fused to one or more of another heterocyclic ring(s), heteroaryl ring(s), aryl ring(s), or cycloalkyl rings. Examples of "heteroaryl" include, but are not limited to, furyl, thiophenyl, pyrrolyl, imidazolyl, pyrazolyl, triazolyl, tetrazolyl, thiazolyl, oxazolyl, isoxazolyl, oxadiazolyl, thiadiazolyl, isothiazolyl, pyridinyl, pyridazinyl, pyrazinyl, pyrimidinyl, quinolinyl, isoquinolinyl, benzofuryl, benzothiophenyl, indolyl, and indazolyl, and the like.

The term "halo" and "halogen" refer to chloro, bromo, fluoro, and iodo.

Compositions

The compositions of the invention include: (a) a solvent having a hydrophilic-lipophilic balance value of 5 to 7; and (b) a solubilizing agent having a formula:

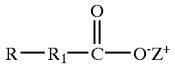

where R is aryl, cycloalkyl, heteroaryl or heterocyclyl; $R_1$ is a bond, $(C_1$–$C_7)$alkyl, substituted $(C_1$–$C_7)$alkyl, $(C_1$–$C_7)$ alkoxy, substituted $(C_1$–$C_7)$alkoxy, $(C_2$–$C_7)$alkenyl, or substituted $(C_2$–$C_7)$alkenyl; and $Z^+$ is hydrogen, Na, K, or $NR'_4$ where R' is independently selected from hydrogen, $(C_1$–$C_{18})$ alkyl, substituted $(C_1$–$C_{18})$alkyl, $(C_1$–$C_{18})$alkoxy, substituted $(C_1$–$C_{18})$alkoxy, $(C_2$–$C_{18})$alkenyl, or substituted $(C_2$–$C_{18})$alkenyl.

The compositions also include: (a) a solvent having a hydrophilic-lipophilic balance value of 5 to 7; and (b) a solubilizing agent having a formula:

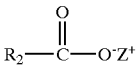

where $R_2$ is $(C_1$–$C_7)$alkyl, substituted $(C_1$–$C_7)$alkyl, $(C_2$–$C_7)$alkenyl or substituted $(C_2$–$C_7)$alkenyl; and $Y^+$ is hydrogen, Na, K, or $NR'_4$ where R' is independently selected from hydrogen, $(C_1$–$C_{18})$alkyl, substituted $(C_1$–$C_{18})$alkyl, $(C_1$–$C_{18})$alkoxy, substituted $(C_1$–$C_{18})$alkoxy, $(C_2$–$C_{18})$ alkenyl, or substituted $(C_2$–$C_{18})$alkenyl.

Solvent

The solvent may be immiscible or insoluble in aqueous solutions. One measure of insolubility is known as hydrophilic-lipophilic balance (HLB).

The solvent may have a hydrophilic-lipophilic balance (HLB) value of 5 to 7. HLB is useful for predicting a solvent's solubility in water. An HLB value less than 7 indicates that the solvent is hydrophobic. The HLB scale was derived initially for surfactants and provides a means for comparing the relative hydrophilicity of amphiphilic molecules. HLB values are also relevant for solvents with pseudo-surfactant qualities, such as glycol ethers. Complete water solubility occurs at an HLB of around 7. Solvents with HLB values above this mark are completely misicible in water, while those below this value are only partially soluble in water. The HLB scale is most useful for visualizing the ease of compatiblizing solvents into water.

Solvents with a HLB value of 5 to 7 include, for example, propylene glycol phenyl ether (i.e., 1-phenoxy-2-propanol), tripropylene glycol n-butyl ether (i.e., (2-(2-butoxymethylethoxy)methylethoxy)-propanol), dipropylene glycol n-butyl ether (i.e., 1-(2-butoxy-1-methylethoxy)-2-propanol), propylene glycol n-butyl ether (i.e., 1-butoxy-2-propanol), dipropylene glycol dimethyl ether (i.e., oxybis (methory)-propane), dipropylene glycol n-propyl ether (i.e., 1-(1-methyl-2-proproxyethyoxy)-2-propanol, or tripopylene glycol n-propyl ether (i.e., 1-(1 or 3-methyl-2-(methyl(-2-propoxyethoxy)ethoxyl-propanol), and the like. These listed solvents are commercially available under the Dowanol tradename from Dow Chemical Company. Additional solvents with a HLB value of 5 to 7 include, for example, benzyl alcohol, 2-phenoxyethanol, and the like. These solvents are commercially available from Aldrich Chemical Company.

Solvents with an HLB value of greater than 7 may be included in the compositions of the invention. Solvents with an HLB value of greater than 7, include, for example, propylene glycol methyl ether, dipropylene glycol methyl ether, tripropylene glycol methyl ether, and the like. These listed solvents are commercially available under the Dowanol tradename from Dow Chemical Company.

As will be apparent to those skilled in the art, the above-listed solvents are merely illustrative and various other solvents meeting the criteria set out above may also be used in the practice of the invention.

The solvent may be present in the solution from at least 1 wt %, or 1 to 99 wt %.

Solubilizing Agent

The solubilizing agent is a substance that increases the solubility in water of another material that is only partially water soluble, such as the solvents listed above. The solubilizing agent of the invention is a non-surfactant carboxylate.

The non-surfactant carboxylate may be an aryl, cycloalkyl, heteroaryl or heterocyclyl carboxylate of the structure:

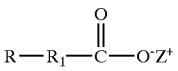

where R is aryl, cycloalkyl, heteroaryl or heterocyclyl; $R_1$ is a bond, $(C_1$–$C_7)$alkyl, substituted $(C_1$–$C_7)$alkyl, $(C_1$–$C_7)$ alkoxy, substituted $(C_1$–$C_7)$alkoxy, $(C_2$–$C_7)$alkenyl, or substituted ($C_2$–$C_7$)alkenyl; and $Z^+$ is hydrogen, Na, K, or $NR'_4$ where R' is independently selected from hydrogen, ($C_1$–$C_{18}$)alkyl, substituted ($C_1$–$C_{18}$)alkyl, ($C_1$–$C_{18}$)alkoxy, substituted ($C_1$–$C_{18}$)alkoxy, ($C_2$–$C_{18}$)alkenyl, or substituted ($C_2$–$C_{18}$)alkenyl.

R may be naphthyl, phenyl, cycloalkyl, cyclohexyl each either unsubstutited or substituted with hydroxyl, halo, or carboxy. $R_1$ may be a bond or ($C_1$–$C_4$)alkyl. $Z^+$ can be $Na^+$.

The compositions also include: (a) a solvent having a hydrophilic-lipophilic balance value of 5 to 7; and (b) a solubilizing agent having a formula:

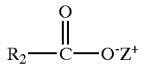

where $R_2$ is ($C_1$–$C_7$)alkyl, substituted ($C_1$–$C_7$)alkyl, ($C_2$–$C_7$)alkenyl or substituted ($C_2$–$C_7$)alkenyl; and $Y^+$ is hydrogen, Na, K, or $NR'_4$ where R' is independently selected from hydrogen, ($C_1$–$C_{18}$)alkyl, substituted ($C_1$–$C_{18}$)alkyl, ($C_1$–$C_{18}$)alkoxy, substituted ($C_1$–$C_{18}$)alkoxy, ($C_2$–$C_{18}$)alkenyl, or substituted ($C_2$–$C_{18}$)alkenyl.

$R_2$ may be ($C_1$–$C_4$)alkyl. $Y^+$ can be $Na^+$.

Examples of non-surfactant carboxylate include the following non-limiting structures:

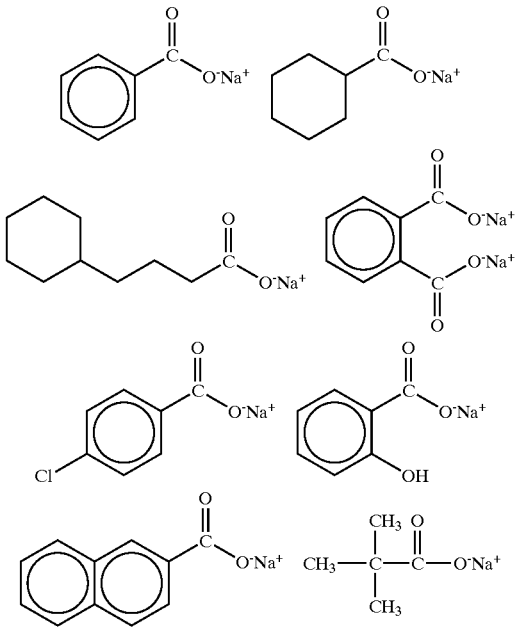

The non-surfactant carboxylate may be present in the composition from 0.01 wt % or 0.01 to 40 wt %.

Water

The compositions of the invention may include water. The solubilizing agent can be present in the composition in an amount effective to increase the solubility of the solvent that is at least partially insoluble in water or having an HBL value of 5 to 7 in water. Enough solubilizing agent can be present in the composition to allow the solvent having an HBL value of 5 to 7 to be completely miscible in the water present.

Water may be present in the composition from 0.01% wt or 0.01 to 99 wt %.

The composition may include any amount of solvent, solubilizing agent or water. The compositions may include 1–99% wt solvent, 1–99% wt water and 0.1–40% wt solubilizing agent based on total weight of solvent, water and solubilizing agent in the compostion. The compositions may include 25–75% wt solvent, 25–75% wt water and 1–20% wt solubilizing agent based on total weight of solvent, water and solubilizing agent in the compostion.

The compositions may include enzymes, enzyme stabilizing system, surfactant, chelating agents, sequestering agents, bleaching agents, alkaline source, secondary hardening agent or solubility modifier, detergent filler, defoamer, anti-redeposition agent, a threshold agent or system, aesthetic enhancing agent (i.e. dye, perfume, ect.) and the like. Adjuvants and other additive ingredients will vary according to the type of composition being manufactured and can be included in the compositions in any amount.

Enzymes

The composition of the invention may includes one or more enzymes, which can provide desirable activity for removal of protein-based, carbohydrate-based, or triglyceride-based stains from substrates; for cleaning, destaining, and sanitizing presoaks, such as presoaks for flatware, cups and bowls, and pots and pans; presoaks for medical and dental instruments; or presoaks for meat cutting equipment; for machine warewashing; for laundry and textile cleaning and destaining; for carpet cleaning and destaining; for cleaning-in-place and destaining-in-place; for cleaning and destaining food processing surfaces and equipment; for drain cleaning; presoaks for cleaning; and the like. Enzymes may act by degrading or altering one or more types of soil residues encountered on a surface or textile thus removing the soil or making the soil more removable by a surfactant or other component of the cleaning composition. Both degradation and alteration of soil residues can improve detergency by reducing the physicochemical forces which bind the soil to the surface or textile being cleaned, i.e. the soil becomes more water soluble. For example, one or more proteases can cleave complex, macromolecular protein structures present in soil residues into simpler short chain molecules which are, of themselves, more readily desorbed from surfaces, solubilized or otherwise more easily removed by detersive solutions containing said proteases.

Suitable enzymes may include a protease, an amylase, a lipase, a gluconase, a cellulase, a peroxidase, or a mixture thereof of any suitable origin, such as vegetable, animal, bacterial, fungal or yeast origin. Selections are influenced by factors such as pH-activity and/or stability optima, thermostability, and stability to active detergents, builders and the like. In this respect bacterial or fungal enzymes may be preferred, such as bacterial amylases and proteases, and fungal cellulases. Preferably the enzyme may be a protease, a lipase, an amylase, or a combination thereof. Enzyme may be present in the composition from at least 0.01 wt %, or 0.01 to 2 wt %.

Enzyme Stabilizing System

The composition of the invention may include an enzyme stabilizing system. The enzyme stabilizing system can include a boric acid salt, such as an alkali metal borate or amine (e.g. an alkanolamine) borate, or an alkali metal borate, or potassium borate. The enzyme stabilizing system can also include other ingredients to stabilize certain enzymes or to enhance or maintain the effect of the boric acid salt.

For example, the cleaning composition of the invention can include a water soluble source of calcium and/or magnesium ions. Calcium ions are generally more effective than magnesium ions and are preferred herein if only one type of cation is being used. Cleaning and/or stabilized enzyme cleaning compositions, especially liquids, may include 1 to 30, 2 to 20, or 8 to 12 millimoles of calcium ion per liter of finished composition, though variation is possible depending on factors including the multiplicity, type and levels of enzymes incorporated. Water-soluble calcium or magnesium salts may be employed, including for example calcium chloride, calcium hydroxide, calcium formate, calcium malate, calcium maleate, calcium hydroxide and calcium acetate; more generally, calcium sulfate or magnesium salts corresponding to the listed calcium salts may be used. Further increased levels of calcium and/or magnesium may of course be useful, for example for promoting the grease-cutting action of certain types of surfactant.

Stabilizing systems of certain cleaning compositions, for example warewashing stabilized enzyme cleaning compositions, may further include 0 to 10%, or 0.01% to 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during warewashing, can be relatively large; accordingly, enzyme stability to chlorine in-use can be problematic.

Suitable chlorine scavenger anions are known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used.

Surfactant

A surfactant may be present in the composition of the invention. The surfactant or surfactant admixture can be selected from water soluble or water dispersible nonionic, semi-polar nonionic, anionic, cationic, amphoteric, or zwitterionic surface-active agents; or any combination thereof. The particular surfactant or surfactant mixture chosen for use in the process and products of this invention can depend on the conditions of final utility, including method of manufacture, physical product form, use pH, use temperature, foam control, and soil type. For a discussion of surfactants, see Kirk-Othmer, Encyclopedia of Chemical Technology, Third Edition, volume 8, pages 900–912. The composition may include a surfactant in an amount effective to provide a desired level of cleaning, such as 0–20 wt %, or 1.5–15 wt %.

Anionic surfactants may include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like.

Nonionic surfactants may include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC™ (BASF-Wyandotte), and the like; and other like nonionic compounds. Silicone surfactants such as the ABIL™ B8852 can also be used.

Cationic surfactants useful for inclusion in a cleaning composition for sanitizing or fabric softening, include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquatemary ammonium chloride surfactants such as n-alkyl ($C_{12}$–$C_{18}$)dimethylbenzyl ammonium chloride, n-tetradecyl dimethylbenzylammonium chloride monohydrate, a naphthylene-substituted quaternary ammonium chloride such as dimethyl-1-naphthylmethylammonium chloride, and the like; and other like cationic surfactants.

Chelating/Sequestering Agent

The composition may include a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. The composition may include 0.1–70 wt %, or 5–60 wt %, of a chelating/sequestering agent. An iminodisuccinate (available commercially from Bayer as IDS™) may be used as a chelating agent.

Useful aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Examples of condensed phosphates useful in the present composition include sodium and potassium orthophosphate, sodium and potassium pyrophosphate, sodium tripolyphosphate, sodium hexametaphosphate, and the like.

The composition may include a phosphonate such as 1-hydroxyethane-1,1-diphosphonic acid and the like.

Polymeric polycarboxylates may also be included in the composition. Those suitable for use as cleaning agents have pendant carboxylate groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, Encyclopedia of Chemical Technology, Third Edition, volume 5, pages 339–366 and volume 23, pages 319–320, the disclosure of which is incorporated by reference herein.

Bleaching Agents

Bleaching agents for lightening or whitening a substrate, include bleaching compounds capable of liberating an active halogen species, such as $Cl_2$, $Br_2$, —$OCl^-$ and/or —$OBr^-$, under conditions typically encountered during the cleansing process. Suitable bleaching agents include, for example, chlorine-containing compounds such as a chlorine, a hypochlorite, chloramine. Halogen-releasing compounds may include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, such as 0.1–10 wt %, or 1–6 wt %.

Detergent Builders or Fillers

A composition may include a minor but effective amount of one or more of a detergent filler which does not perform as a cleaning agent per se, but cooperates with the cleaning agent to enhance the overall cleaning capacity of the composition. Examples of fillers suitable for use in the present cleaning compositions include sodium sulfate, sodium chloride, starch, sugars, $C_1$–$C_{10}$ alkylene glycols such as propylene glycol, and the like. Inorganic or phosphate-containing detergent builders may include alkali metal, ammonium and alkanolammonium salts of polyphosphates (e.g. tripolyphosphates, pyrophosphates, and glassy polymeric meta-phosphates). Non-phosphate builders may also be used. A detergent filler may be included in an amount of 1–20 wt %, or 3–15 wt %.

Defoaming Agents

A minor but effective amount of a defoaming agent for reducing the stability of foam may also be included in the compositions. The cleaning composition can include 0.01–5 wt % of a defoaming agent, or 0.01–3 wt %.

Examples of defoaming agents include silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-redeposition Agents

The composition may include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. The composition may include 0.5–10 wt %, or 1–5 wt %, of an anti-redeposition agent.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as ClS-jasmine or jasmal, vanillin, and the like.

Alkalinity Source

An alkalinity source may be provided to increase the pH of composition. Exemplary alkalinity sources include an alkali metal silicate, hydroxide, phosphate, or carbonate.

The alkalinity source can include an alkali metal hydroxide including sodium hydroxide, potassium hydroxide, lithium hydroxide, etc. Mixtures of these hydroxide species can also be used. Alkaline metal silicates can also act as a source of alkalinity for the detergents of the invention.

The alkalinity source can include an alkali metal carbonate. Alkali metal carbonates which may be used include sodium carbonate, potassium carbonate, sodium or potassium bicarbonate or sesquicarbonate, among others. These sources of alkalinity can be used the compositions of the invention at concentrations of 0.1 wt-% to 70 wt-%, 1 wt-% to 30 wt-%, or 5 wt-% to 20 wt-%.

Divalent Ion

The compositions of the invention may contain a divalent ion, selected from calcium and magnesium ions, at a level of from 0.05% to 5% by weight, or from 0.1% to 1% by weight, or 0.25% by weight of the composition. The divalent ion can be, for example, calcium or magnesium. The calcium ions can, for example, be added as a chloride, hydroxide, oxide, formate, acetate, nitrate salt.

Polyol

The composition of the invention can also include a polyol. The polyol may provide additional stability and hydrotrophic properties to the composition. Propylene glycol and sorbitol are preferred polyols.

The compositions of the invention may also contain additional typically nonactive materials, with respect to cleaning properties, generally found in liquid pretreatment or detergent compositions in conventional usages. These ingredients are selected to be compatible with the materials of the invention and include such materials as fabric softeners, optical brighteners, soil suspension agents, germicides, viscosity modifiers, inorganic carriers, solidifying agents and the like.

The above compositions can be made by combining water with a solvent having a HLB value of 5 to 7 and a solubilizing agent defined above to form a stable single phase solution. The above processes can be used to produce a product having a stable single solution phase. The compositions can be diluted with aqueous and/or non aqueous materials to form a use solution of any strength depending on the application. The compositions and diluted use solutions may be useful as, for example, detergents for laundry, warewashing, vehicle care, sanitizing, ect.

EXAMPLES

Formulations were created by combining the components in the amounts listed in the tables below. A base composition consisted of water and solvents having an HLB value of a 5–7 shown in the table below:

| Component | Wt % |
|---|---|
| Water | 55 |
| Diproplyene Glycol n-Butyl Ether (Dowanol DPnB ™) | 20 |
| Benzyl Alcohol | 15 |
| Propylene Glycol Phenyl Ether | 10 |

Several non-surfactant solubilizing agent were obtained from Aldrich Chemical Company and added to the base composition to determine if they where able to solubilize solvents having an HLB value of 5–7 into water. The table below indicates whether each non-surfactant solubilizing agent solubilized the solvents having an HLB value of a 5–7 into the water at concentration of 5%, 10% or 15% of the base composition.

| $R—R_1—C(=O)—O^-Z^+$ | | | wt % of Non-Surfactant Solubilizing Agent | | |
|---|---|---|---|---|---|
| R | $R_1$ | $Z^+$ | 5% | 10% | 15% |
| 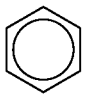 | Bond | Na | Yes | Yes | Yes |
| 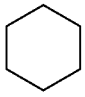 | Bond | Na | Yes | Yes | Yes |
| 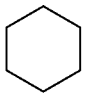 | $(CH_2)_3$ | Na | Yes | Yes | Yes |
| 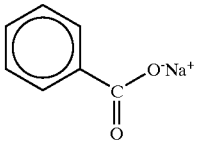 (Ortho) | Bond | Na | No | No | Yes |
| 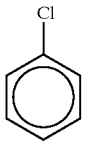 (para) | Bond | Na | Yes | Yes | Yes |
| 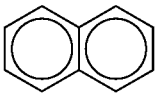 | Bond | Na | Yes | Yes | Yes |
| 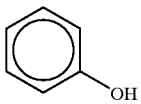 (ortho) | Bond | Na | Yes | Yes | Yes |

-continued

| $R_2—C(=O)—O^-Y^+$ | | wt % of Non-Surfactant Solubilizing Agent | | |
|---|---|---|---|---|
| $R_2$ | $Y^+$ | 5% | 10% | 15% |
| 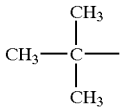 | Na | No | Yes | Yes |

A formulation useful as a hard surface cleaner was formed by combining the components in the amounts listed in the table below.

Formulation A

| Component | Weight % |
|---|---|
| Water | 32.8 |
| Dipropylene Glycol n-Butyl Ether[1] | 12 |
| Benzyl Alcohol | 10 |
| Propylene Glycol Phenyl Ether[2] | 6 |
| Sodium Benzoate | 8 |
| Tall Oil Fatty Acid | 6 |
| Caustic Soda | 2 |
| Linear alcohol ethoxylate[3] | 6 |
| Sodium Xylene Sulfonate[4] | 6 |
| Na EDTA[5] | 7 |
| Dye[6] | 0.2 |

[1]Dowanol DPnB is commercially available from the Dow Chemical Co.
[2]Dowanol PPh is commercially available from the Dow Chemical Co.
[3]Neodol 1–9 is commercially available from Shell Chemical Co.
[4]SXS 40% is commercially available from Pilot Chemical Co.
[5]Versene 100 is commercially available from Dow Chemical Co.
[6]Direct Blue 86 1% soln is commercially available from Miles Chemical Co.

Formulation A above provide a cleaning solution that can be used as a dilutable degreaser for stainless steel surfaces, a non-dilutable aluminum pan cleaner that is metal safe, a hard surface cleaner, a graffiti remover or a floor cleaner and the like.

Aqueous solutions of dipropylene glycol n-butyl ether (DPnB), propylene glycol phenyl ether(PPh), and benzyl alcohol were prepared and sodium benzoate was added at room temperature to each solution until a single phase solution was observed. Results are reported below.

| Water (wt %) | PPh (wt %) | Na Benzoate (wt %) |
|---|---|---|
| 93 | 1 | 6 |
| 83 | 2 | 15 |
| 79 | 4 | 17 |
| 74 | 8 | 18 |
| 69 | 12 | 19 |
| 63 | 16 | 21 |
| 58 | 25 | 17 |
| 43 | 43 | 14 |

| Water (wt %) | DPnB (wt %) | Na Benzoate (wt %) |
|---|---|---|
| 99 | 1 | 0 |
| 98 | 2 | 0 |
| 86 | 4 | 10 |
| 79 | 9 | 12 |

-continued

| | | |
|---|---|---|
| 75 | 13 | 12 |
| 70 | 18 | 12 |
| 62 | 26 | 12 |
| 45 | 45 | 10 |

| Water (wt %) | Benzyl Alcohol (wt %) | Na Benzoate (wt %) |
|---|---|---|
| 99 | 1 | 0 |
| 98 | 2 | 0 |
| 85 | 4 | 11 |
| 78 | 9 | 13 |
| 74 | 13 | 13 |
| 69 | 17 | 14 |
| 61 | 26 | 13 |
| 44 | 44 | 12 |

Those skilled in the art will recognize that the present invention may be manifested in a variety of forms other than the specific embodiments described and contemplated herein. Accordingly, departures in form and detail may be made without departing from the scope and spirit of the present invention as described in the appended claims.

We claim:

1. A single phase aqueous composition comprising:

water, a solvent having a hydrophilic-lipophilic balance value of 5 to 7; and a solvent solubilizing amount of a solubilizing agent having a formula:

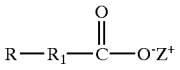

wherein:

R is aryl or heteroaryl;

$R_1$ is a bond, $(C_1-_7)$alkyl, substituted $(C_1-C_7)$alkyl, $(C_1-C_7)$alkoxy, substituted $(C_1-C_7)$alkoxy, $(C_2-C_7)$ alkenyl, or substituted $(C_2-C_7)$alkenyl; and $Z^+$ is hydrogen, Na, K, or $NR'_4$ where R' is independently selected from group consisting of hydrogen, $(C_1-C_{18})$ alkyl, substituted $(C_1-C_{18})$alkyl, $(C_1-C_{18})$alkoxy, substituted $(C_1-C_{18})$alkoxy, $(C_2-C_{18})$alkenyl, and substituted $(C_2-C_{18})$alkenyl; and wherein the composition comprises sufficient solubilizing agent to solubilize the solvent into the water, and the solvent is present at 25–75 wt %, water is present at 25–75 wt %, and solubilizing agent is present at 1–20 wt % of solvent, water and solubilizing agent total weight.

2. The composition of claim 1, wherein R is aryl.

3. The composition of claim 1, wherein R is naphthyl.

4. The composition of claim 1, wherein R is phenyl.

5. The composition of claim 1, wherein $R_1$ is a bond.

6. The composition of claim 1, wherein $Z^+$ is Na.

7. The composition of claim 1, wherein the solubilizing agent is sodium benzoate.

8. The composition of claim 1, wherein the solvent is 1-phenoxy-2-propanol, 2-phenoxyethanol, (2-(2-butoxymethylethoxy)methylethoxy)-propanol, 1-(2-butoxy-1-methylethoxy)-2-propanol, 1-butoxy-2-propanol, or benzyl alcohol.

9. The composition of claim 1, further comprising a builder.

10. The composition of claim 1, further comprising an enzyme.

11. The composition of claim 1, further comprising an enzyme stabilizing system.

12. The composition of claim 1, further comprising an alkaline source.

13. The composition of claim 1, further comprising a surfactant.

14. The composition of claim 1, further comprising an oxidizing source.

15. A single phase aqueous composition comprising:

water;

a solvent having a hydrophilic-lipophilic balance value of 5 to 7; and a solvent solubilizing amount of a solubilizing agent having a formula:

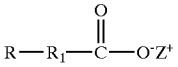

wherein:

R is cycloalkyl or heterocyclyl;

$R_1$ is a bond, $(C_1-C_7)$alkyl, substituted $(C_1-C_7)$alkyl, $(C_1-C_7)$alkoxy, substituted $(C_1-C_7)$alkoxy, $(C_2-C_7)$ alkenyl, or substituted $(C_2-C_7)$alkenyl;

$Z^+$ is hydrogen, Na, K, or $NR'_4$ where R' is independently selected from group consisting of hydrogen, $(C_1-C_{18})$ alkyl, substituted $(C_1-C_{18})$alkyl, $(C_1-C_{18})$alkoxy, substituted $(C_1-C_{18})$alkoxy, $(C_2-C_{18})$alkenyl, and substituted $(C_2-C_{18})$alkenyl; and wherein the composition comprises sufficient solubilizing agent to solubilize the solvent into the water.

16. The composition of claim 15, wherein R is cycloalkyl.

17. The composition of claim 15, wherein $R_1$ is a bond.

18. The composition of claim 15, wherein $Z^+$ is Na.

19. The composition of claim 15, wherein the solvent is 1-phenoxy-2-propanol, 2-phenoxyethanol, (2-(2-butoxymethylethoxy)methylethoxy)-propanol, 1-(2-butoxy-1-methylethoxy)-2-propanol, 1-butoxy-2-propanol, or benzyl alcohol.

20. The composition of claim 15, wherein the solvent is present at 1–99 wt %, water is present at 1–99 wt %, and solubilizing agent is present at 0.1–40 wt % of solvent, water and solubilizing agent total weight.

21. The composition of claim 15, wherein the solvent is present at 25–75 wt %, water is present at 25–75 wt %, and solubilizing agent is present at 1–20 wt % of solvent, water and solubilizing agent total weight.

22. A composition comprising:

a. a solvent having a hydrophilic-lipophilic balance value of 5 to 7, wherein the solvent is 1-phenoxy-2-propenol, 2-phenoxyethanol, (2-(2-butoxymethylethoxy) methylethoxy)-propanol, 1-(2-butoxy-1-methylethoxy)-2-propanol, 1-butoxy-2-propanol, or benzyl alcohol; and b. a solubilizing agent having a formula:

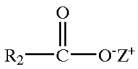

wherein:

$R_2$ is a $C_4$ alkyl;

$Y^+$ is hydrogen, Na, K, or $NR'_4$ where R' is independently selected from group consisting of hydrogen, $(C_1-C_{18})$ alkyl, substituted $(C_1-C_{18})$alkyl, $(C_1-C_{18})$alkoxy, substituted $(C_1-C_{18})$alkoxy, $(C_2-C_{18})$alkenyl, and substituted $(C_2-C_{18})$alkenyl.

23. The composition of claim 22, further comprising water.

24. The composition of claim 23, wherein the solvent is present at 1–99 wt %, water is present at 1–99 wt %, and solubilizing agent is present at 0.1–40 wt % of solvent, water and solubilizing agent total weight.

25. The composition of claim 23, wherein the solvent is present at 25–75 wt %, water is present at 25–75 wt %, and solubilizing agent is present at 1–20 wt % of solvent, water and solubilizing agent total weight.

26. The composition of claim 22, further comprising a builder.

27. The composition of claim 22, further comprising an enzyme.

28. The composition of claim 22, further comprising an enzyme stabilizing system.

29. The composition of claim 22, further comprising an alkaline source.

30. The composition of claim 22, further comprising a surfactant.

31. The composition of claim 22, further comprising an oxidizing source.

32. A process comprising:

a. providing a solvent having a hydrophilic-lipophilic balance value of 5 to 7; and b. providing a solubilizing agent having a formula:

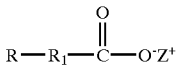

wherein:

R is aryl or heteroaryl;

$R_1$ is a bond, $(C_1–C_7)$alkyl, substituted $(C_1–C_7)$alkyl, $(C_1–C_7)$alkoxy, substituted $(C_1–C_7)$alkoxy, $(C_2–C_7)$ alkenyl, or substituted $(C_2–C_7)$alkenyl;

$Z^+$ is hydrogen, Na, K, or $NR'_4$ where R' is independently selected from group consisting of hydrogen, $(C_1–C_{18})$ alkyl, substituted $(C_1–C_{18})$alkyl, $(C_1–C_{18})$alkoxy, substituted $(C_1–C_{18})$alkoxy, $(C_2–C_{18})$alkenyl, or substituted $(C_2–C_{18})$alkenyl; and c. combining the solvent and solubilizing agent with water forming a stable single phase solution, where the solubilizing agent solubilizes the solvent into the water and the solvent is present at25–75 wt %, water is present at 25–75 wt %, and solubilizing agent is present at 1–20 wt % of solvent, water and solubilizing agent total weight in the stable single phase solution.

33. The process of claim 32, wherein R is aryl.

34. The process of claim 32, wherein R is naphthyl.

35. The process of claim 32, wherein R is phenyl.

36. The process of claim 32, wherein $R_1$ is a bond.

37. The process of claim 32, wherein $Z^+$ is Na.

38. The process of claim 32, wherein the solubilizing agent is sodium benzoate.

39. The process of claim 32, wherein the solvent is 1-phenoxy-2-propanol, 2-phenoxyethanol, (2-(2-butoxyrnethylethoxy)methylethoxy)-propanol, 1-(2-butoxy-1-methylethoxy)-2-propanol, 1-butoxy-2-propanol, or benzyl alcohol.

40. A product formed by the process of claim 32.

41. A process comprising:

a. providing a solvent having a hydrophilic-lipophilic balance value of 5 to 7; and b. providing a solubilizing agent having a formula:

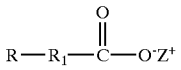

wherein:

R is cycloalkyl or heterocyclyl;

$R_1$ is a bond, $(C_1–C_7)$alkyl, substituted $(C_1–C_7)$alkyl, $(C_1–C_7)$alkoxy, substituted $(C_1–C_7)$alkoxy, $(C_2–C_7)$ alkenyl, or substituted $(C_2–C_7)$alkenyl;

$Z^+$ is hydrogen, Na, K, or NR'4 where R' is independently selected from group consisting of hydrogen, $(C_1–C_{18})$ alkyl, substituted $(C_1–C_{18})$alkyl, $(C_1–C_{18})$alkoxy, substituted $(C_1–C_{18})$alkoxy, $(C_2–C_{18})$alkenyl, or substituted $(C_2–C_{18})$alkenyl;

c. combining the solvent and solubilizing agent with water forming a stable single phase solution, where the solubilizing agent solubilizes the solvent into the water.

42. The process of claim 41, wherein R is cycloalkyl.

43. The process of claim 41, wherein $R_1$ is a bond.

44. The process of claim 41, whererin $Z^+$ is Na.

45. The process of claim 41, wherein the solvent is 1-phenoxy-2-propanol, 2-phenoxyethanol, (2-(2-butoxymethylethoxy)methylethoxy)-propanol, 1-(2-butoxy-1-methylethoxy)-2-propanol, 1-butoxy-2-propanol, or benzyl alcohol.

46. The process of claim 41, wherein the solvent is present at 1–99 wt %, water is present at 1–99 wt %, and solubilizing agent is present at 0.1–40 wt % of solvent, water and solubilizing agent total weight in the stable single phase solution.

47. The process of claim 41, wherein the solvent is present at 25–75 wt %, water is present at 25–75 wt %, and solubilizing agent is present at 1–20 wt % of solvent, water and solubilizing agent total weight in the stable single phase solution.

48. A product formed by the process of claim 32.

49. A process comprising:

a. providing a solvent having a hydrophilic-lipophilic balance value of 5 to 7, wherein the solvent is 1-phenoxy-2-propanol, 2-phenoxyethanol, (2-(2-butoxymethylethoxy)methylethoxy)-propanol, 1-(2-butoxy-1-methylethoxy)-2-propanol, 1-butoxy-2-propanol, or benzyl alcohol; and b. providing a solubilizing agent having a formula:

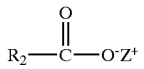

wherein:

$R_2$ is a $C_4$ alkyl;

$Y^+$ is hydrogen, Na, K, or $NR'_4$ where R' is independently selected from group consisting of hydrogen, $(C_1–C_{18})$ alkyl, substituted $(C_1–C_{18})$alkyl, $(C_1–C_{18})$alkoxy, substituted $(C_1–C_{18})$alkoxy, $(C_2–C_{18})$alkenyl, or substituted $(C_2–C_{18})$alkenyl; and c. combining the solvent and solubilizing agent with water forming a stable single phase solution.

50. The process of claim 49, wherein the solvent is present at 1–99 wt %, water is present at 1–99 wt %, and solubilizing agent is present at 0.1–40 wt % of solvent, water and solubilizing agent total weight in the stable single phase solution.

51. The process of claim 49, wherein the solvent is present at 25–75 wt %, water is present at 25–75 wt %, and solubilizing agent is present at 1–20 wt % of solvent, water and solubilizing agent total weight in the stable single phase solution.

52. A product formed by the process of claim 49.

* * * * *